United States Patent [19]

Kochem

[11] 4,400,765

[45] Aug. 23, 1983

[54] OPERATING ROOM LIGHT FIXTURE WITH ADJUSTABLE LIGHT PATTERN

[75] Inventor: Winfried Kochem, Ransbach-Baumbach, Fed. Rep. of Germany

[73] Assignee: Original Hanau Heraeus GmbH, Hanau, Fed. Rep. of Germany

[21] Appl. No.: 235,695

[22] Filed: Feb. 18, 1981

[30] Foreign Application Priority Data

Mar. 29, 1980 [DE] Fed. Rep. of Germany ..... 3012340

[51] Int. Cl.[3] ..... F21Y 7/16

[52] U.S. Cl. ..... 362/277; 362/33; 362/297; 362/300; 362/319; 362/346; 362/804

[58] Field of Search ..... 362/33, 277, 280, 297, 362/300, 346, 319, 804

[56] References Cited

U.S. PATENT DOCUMENTS 3,832,539 8/1974 Oram ..... 362/804 X
4,288,844 9/1981 Fisher et al. ..... 362/33 X

FOREIGN PATENT DOCUMENTS 1736112 of 1956 Fed. Rep. of Germany .
2133719 of 1973 Fed. Rep. of Germany .
375943 of 1932 United Kingdom .

*Primary Examiner*—Peter A. Nelson
*Attorney, Agent, or Firm*—Frishauf, Holtz, Goodman & Woodward

[57] ABSTRACT

A light source 2 projects light through a lens system which, preferably, has interchangeable lenses 4, 4', 4'' to a conical reflecting body 6 with a reflecting surface 5, from which the light is reflected laterally to a ring reflector 8, to be in turn reflected to an operating field 17 to be illuminated. To permit distance adjustment of the operating room light fixture with respect to the illuminated field 17, a plurality of reflecting bodies 6, 6', with respective reflecting surfaces 5, 5' of different characteristics, for example a ridge surface, concave, conical or the like, are positioned on a drum for selective placement in the beam of light 7 from the lenses. Additionally, the position of the selected reflecting bodies 6, 6' with respect to the light source can be changed by locating the reflecting body on a cam follower and positioning of a camming surface with respect thereto to change the distance between the reflecting body 6 and the light source.

12 Claims, 3 Drawing Figures

OPERATING ROOM LIGHT FIXTURE WITH ADJUSTABLE LIGHT PATTERN

The present invention relates to an operating room light fixture, and more particularly to such a fixture which has an adjustable light pattern, in which a light source provides a beam of light which is reflected from a central reflection element to a ring reflector.

BACKGROUND

Operating room lights with ring reflectors are known—see British Pat. No. 375,943—which provide a field of light to a utilization surface, typically an operating room table. Light sources of this type have a central reflection element which has a reflection surface rotary symmetrically with respect to the axis of a ring reflector. A parallel beam of light is focused on the ring reflector which in turn reflects the light to the operating region to be illuminated.

THE INVENTION

It is an object to improve an operating room light having a ring reflector which provides essentially shadow-free illumination of the operating field independently of the distance between the operating field and the lamp itself, and which, preferably, additionally permits change of the intensity of illumination and the size of the illuminated field in readily controllable predetermined manner.

Briefly, the reflecting surface of the rotary symmetrical reflection element is interchangeable with respect to reflecting surfaces or reflecting elements of different reflecting geometry. For example, the size or shape of the reflecting surface, or the surface configuration thereof—whether smooth, patterned or striated, or the like—can be changed.

In accordance with a feature of the invention, a plurality of reflecting elements are located on a turret carrier which is externally controllable, so that a desired reflecting element having reflecting characteristics resulting in the desired reflected light pattern can be brought into the beam of light from the source to the ring reflector, to thereby obtain an illuminated field of light with the desired characteristics. Additionally, and preferably, the relative position between the central reflecting element and the ring reflector can be changed, for example by a relative height adjustment, to additionally change the reflecting characteristics of the lamp.

The operating room light has the advantage that the illumination condition of the operating field itself can be optimized regardless of the distance of the operating field from the lamp. Thus, independent setting of the illuminating condition with respect to lamp position is possible. Depending on the operation to be carried out, the distribution of light with respect to the light intensity, that is, the light illumination pattern, can be controlled without interfering with simple setting and positioning of the operating room light in accordance with standard construction.

Figure 1:
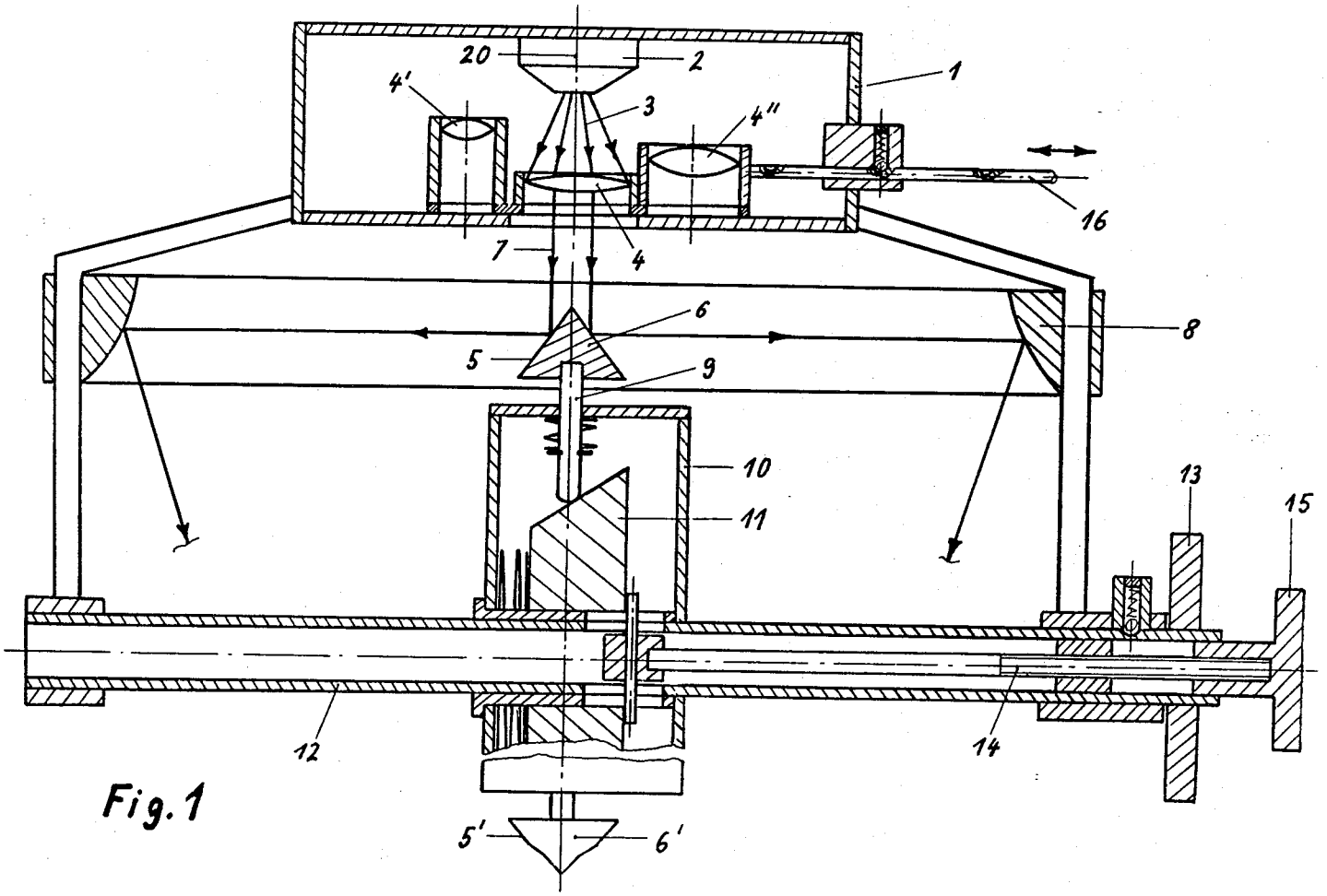
FIG. 1 is a schematic vertical sectional view through an operating room light and illustrating additionally the paths of a beam of light from a source.

A housing 1 (FIG. 1) retains a light source 2 which emits a beam of light 3 to fall on a lens 4 where the light is collimated and converted to a parallel path which is reflected from the reflection surface 5 of a rotary-symmetrical reflection element or body 6. The reflection surface 5 is rotary-symmetrical with respect to the central axis 20 of a ring reflector 8 secured to, or forming part, of the housing 1. The parallel beam of light 7, derived from the lens 3, is reflected by the reflecting element 6 towards a ring reflector 8 to then form a ring of light beams 18 (FIG. 2) to provide essentially flat illumination at an intersecting plane 17, which corresponds to the operating field to be illuminated. The reflecting element 6 is secured to a holding rod 9 which extends through an opening into a drum 10. The lower portion of the rod 9 is located on an inclined surface of an adjustment element 11. A plurality of reflecting bodies 6 are located on the circumference of the drum 10, only one additional body 6' being shown in FIG. 1. The respective reflecting surfaces 5' of the additional reflecting bodies 6' have respectively different reflecting geometry. The respective reflecting bodies with their respectively different reflection surfaces located at the circumference of the drum 10 can be placed in the position of the light beam 7 from the lens 4 by rotation of the drum 10 about a pivot axis 12 by a hand wheel 13, to be introduced, sequentially and as desired, into the beam of light 7. The manually or automatically controllable wheel 13 which, for example, can be positioned by a stepping motor, thus permits placing, as desired, reflecting elements 6, 6', etc., in the beam of light 7 to obtain desired fields of illumination. The field distribution and the illumination intensity at the operating field 17 (FIG. 2) thus can be selectively changed. Preferably, the shaft 12 providing for rotary adjustment of the drum 10 is hollow, and receives a spindle 17 connected to the adjustment element 11 and permitting sliding to-and-fro movement by the operating element 15, for example a plunger. By reciprocating the plunger 15 from left to right, see FIG. 1, the position of body 11 with respect to the plunger 9 is changed, and thus the distance between the source of light and the reflecting body 5 with respect to the lens 4 is changed. Change of the distance between the reflecting body 5 and the source of light or lens 4, respectively, changes the inclination of the light beams reflected from the ring reflector 8 to the operating field. Body 11, thus, acts like a cam. Its positioning can, of course, also be obtained by providing a thread on a portion of the spindle 14, operating in a fixed nut, so that rotation of the operating element 15 changes the left-to-right position of the cam element 11. As schematically shown in the drawings, springs are provided to hold the cam element in position with respect to cam 11 and the plunger 9 in engagement with the camming surface of body 11. Other suitable arrangements, preferably including a cam, to position the body 6 with respect to the lens 4 may be used.

In accordance with a preferred embodiment of the invention, the beam formation of the light derived from the light source 2 and directed to the body 6 can be selectively controlled. A plurality of lenses 4, 4', 4'' are provided. A reciprocatable control rod 16 permits selective placement of either one of the lenses 4, 4', 4'' in the beam of light from the source 2 to the reflecting surface 5 of the reflecting body 6. By changing the lenses, the diameter of the parallel beam of light 7 can be changed, resulting in a change in the size of the illuminated surface of the operating field, and hence a change in the light intensity of the illuminated field 17 (FIG. 2).

The reflecting surfaces of the ring reflector 8, in the example shown, are convex. This permits use of a relatively small reflector.

Figure 2:
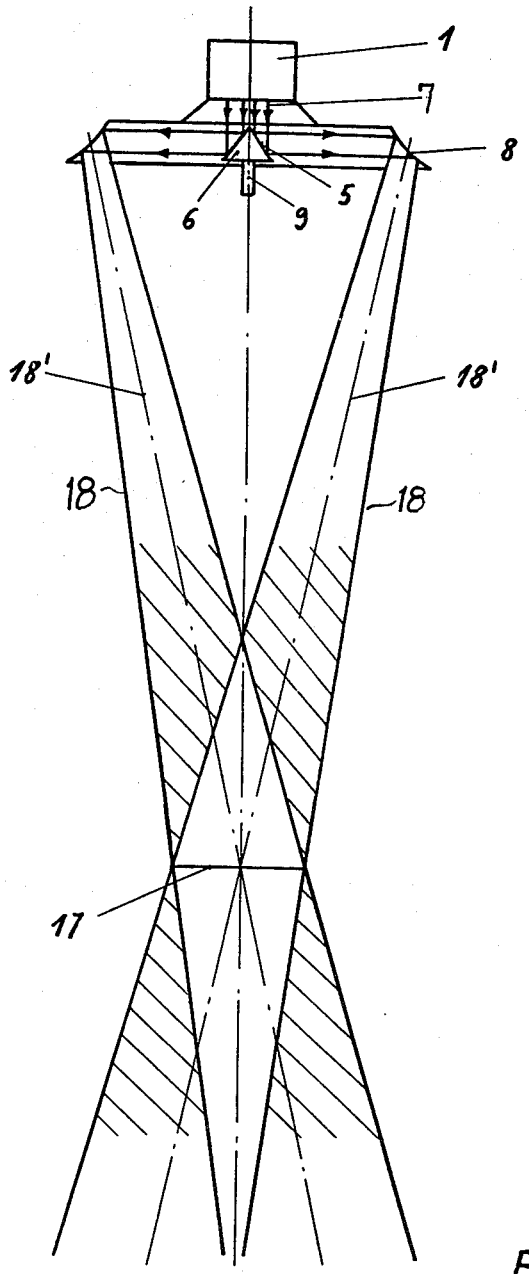
FIG. 2 is a highly schematic representation of the light beam paths with a ring reflector, in which only the optically effective portions of the operating room light fixture are shown.

The path of the beam of light is schematically shown in FIG. 2; as there illustrated, the light emitted from light source 2 in housing 1, and collimated by lens 4 into a beam 7, is reflected by the reflection surface 5 of the reflecting element 6 to the ring reflector 8 and then reflected downwardly to the operating field 17. The axis of the beams is shown at 18'. The axes 18' of the ring of light, which, in cross section, will be diametrically opposite with respect to the reflector 8, intersect at the center of the operating field 17, resulting in optimum illumination of the area to be illuminated, that is, the overall operating field. Essentially shadow-free, uniform, practically shadowless illumination of the field 17 is obtained.

If it is desired to move the operating room light with respect to the operating table, for example, and with a fixed reflecting system in accordance with the prior art, the optimum illumination of the field 17, at the intersection of the axes 18', will no longer obtain.

In accordance with the present invention, the reflecting body or element 6, and hence its reflecting surface 5, can be moved with respect to the light source in housing 1, which results in tilting of the axis 18' of the resulting ring of light. By suitable adjustment, the axes 18' can thus be made to always intersect at the selected operating field 17 regardless of its distance from the operating room light, within a given adjustment range determined by the overall design, size of reflecting surfaces, and adjustment range. The size of the illuminated operating room field can be changed by interchanging the lenses 4, 4', 4'' (FIG. 1).

Figure 3:
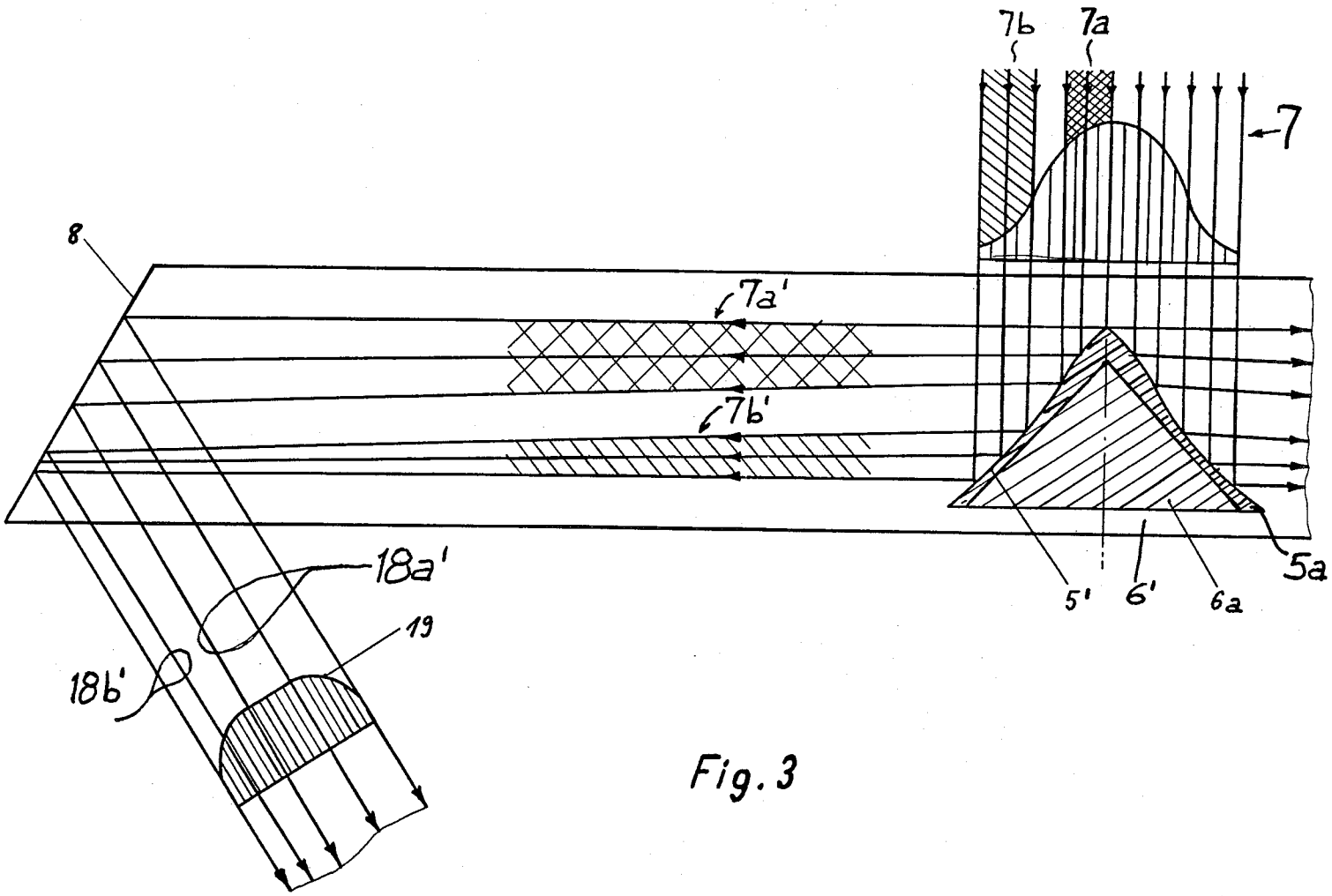
FIG. 3 is a fragmentary highly enlarged beam path also illustrating light beam pattern distribution.

The field distribution of light, that is, the intensity pattern on the surface 17 likewise can be controlled by suitable selection of a respective reflecting body 6, 6' having a selected reflecting surface 5' (FIG. 3) which has a different reflector geometry. By inserting a reflector body 6' which has a concave reflecting surface 5', a field distribution of light intensity in the operating field 17 can be adjusted which, taken across the entire area of field 17, is essentially uniform, with drop-off only at the extreme marginal portions. If desired, the light distribution can be so selected that the marginal portions have a higher degree of intensity than the central portions. The reflected areas of beam portions *7a, 7b,* reflected by surface 5' to form beams *7a', 7b',* and reflected by surface 8 to form reflected beams 18*a'*, 18*b'*, are shown in FIG. 3, together with the light distribution pattern 19. Depending on the geometry of the reflecting surface 5, 5' of the reflecting element 6, 6', the distribution 19 can be suitably controlled.

FIG. 3 illustrates a further modification, namely showing a reflecting body 6' which is a two-element structure, having a support or central portion 6*a* on which a separate reflecting surface portion 5*a*, with the desired reflecting surface, here 5', is secured. The reflecting surface may, for example, be held on by clips, a plastic ring, pins extending into the body 6', or other suitable attachment means, if to be replaceable, or can be adhered with a permanent or releasable adhesion agent.

The body 6 is generally of conical form; as used herein, the term "cone" is not to be taken in the mathematical sense as a precise mathematical cone since the outer surface may be suitably shaped —see FIG. 3, surface 5'—for selected light distribution. The term "cone" as used herein, thus, is to be deemed to relate to the general aspect or appearance.

Adjustment of the light directing cone 6 in axial direction changes the distance between the cone 6 and the respectively selected lens 4 and, of course, the distance of the center of the beam with respect to the ring reflector 8 and hence the distance of the field 17 from the fixture at the point of intersection of the centers 18' of the beam. The lateral size of the field, that is, the transverse areal extension, is determined by the focal length of the respective lens 4, 4', 4'' which is selected. Of course, a broader beam will have, the light source 2 being the same, a lesser light intensity per unit area.

Various changes and modifications may be made, and features described in connection with any one of the embodiments may be used with any of the others, within the scope of the inventive concept.

I claim:

1. Operating room light fixture with adjustable light distribution pattern having a support structure (1);

a ring reflector (8) located on the support structure;

a cone reflector means (6) located centrally within the ring reflector (8);

light directing means (2, 3, 4) directing a beam of light (3, 7) on said cone reflector along the central axis (20) thereof for reflection from an essentially conical surface (5, 5') to the ring reflector (8) and subsequent reflection to a surface (17) to be illuminated; and comprising, in accordance with the invention, a plurality of reflecting bodies (6, 6') forming the cone reflector means and having, respectively, different reflecting surfaces (5, 5') of different reflection characteristics or geometry positioned on said structure;

and means for interchangeably positioning a selected one of the plurality of cone bodies (6, 6') in the path of the beam of light for interchange of a reflecting surface with another reflecting surface of different reflection characteristics or geometry.

2. Fixture according to claim 1, wherein at least one of the reflecting cone bodies comprises a cone element (6*a*) and a separate reflecting surface (5*a*) secured to said cone element and fitted thereon.

3. Fixture according to claim 1, wherein the reflecting surface (5) of the reflecting cone body (6) has a reflection geometry which results in a beam of light falling on the surface (17) to be illuminated which is essentially of uniform intensity throughout the field.

4. Fixture according to claim 1, wherein the reflecting surface (5) of the reflecting cone body (6) has a reflecting geometry which results in a beam on the surface (17) to be illuminated, in which the marginal portions have a different intensity of light than the central portions thereof.

5. Fixture according to claim 1 or 2 or 3 or 4, wherein the reflecting surface of the ring reflector (8) is convex.

6. Fixture according to claim 1 or 2 or 3 or 4, including movable support means (9) supporting the reflecting cone bodies 6' in said support structure for movement relative to the light directing means and the ring reflector (8) in the direction of the central axis (20).

7. Fixture according to claim 1, wherein the ring reflector (8) is fixedly secured in the support structure;

and the reflector means (6) is movable with respect to the ring reflector.

8. Fixture according to claim 7, wherein, to effect relative adjustable positioning of the reflector means (6) with respect to the ring reflector (8), a camming means (9, 11) is provided having a camming surface (11) and a cam follower (9), the relative position of the camming surface and the cam follower being operator-adjustable to effect relative movement between the reflector means (6) and the ring reflector (8).

9. Fixture according to claim 8, wherein the cam comprises an inclined surface diametrically movable wth respect to the ring reflector, and the cam follower comprises a support pin (9) and for positioning the reflector means (6);

and operator-movable means positioning the inclined surface with respect to the cam follower pin.

10. Fixture according to claim 1, wherein the means interchangeably positioning the reflecting cone bodies comprises a turret (10) the plurality of reflecting bodies (6, 6') being positioned on said turret;

and operator-controllable positioning means (13) controlling the rotary positioning of said turret with respect to the beam of light derived from the light directing means to, selectively, place a selected reflecting cone body with a respectively selected light reflection surface (5, 5') thereon in the path of the beam of light from the light directing means to the ring reflector.

11. Fixture according to claim 10, wherein said turret (10) comprises a rotatable hollow structure located, at least in part, in alignment with said central axis (20) and supported on said support structure (1);

a camming structure (11) including an inclined surface positioned within said hollow turret (10);

a cam follower (9) in engagement with said camming structure, said camming structure being diametrically movable and comprising an essentially ring-shaped element with the outer face forming said inclined surface;

said reflecting cone bodies (6, 6') being supported by respective cam follower pins in engagement with said inclined surface;

and means (14, 15) diametrically adjusting the position of said camming structure (11) with respect to said axis to thereby position a selected reflecting cone (6) in the beam of light axially relative to the ring reflector and the light directing means (2, 3, 4) to control the distance of maximum illumination intensity with respect to said fixture and permit relative adjustment and control of the light distribution pattern of illumination at said surface (17).

12. Fixture according to claim 1 or 8 or 9 or 10 or 11, wherein said light directing means includes a plurality of lenses (4, 4', 4'') of different focal lengths, and means (16) selectively placing a selected one of said lenses in the path (3, 7) of light from a source (2) to said reflector means (6) to permit additional control of the spread of light, and relative intensity of said surface (17) to be illuminated.

* * * * *